US006537387B1

(12) United States Patent
Riesop

(10) Patent No.: US 6,537,387 B1
(45) Date of Patent: Mar. 25, 2003

(54) CORROSION PROTECTION FOR GALVANIZED AND ALLOY GALVANIZED STEEL STRIPS

(75) Inventor: Joerg Riesop, Kerpen (DE)

(73) Assignee: Henkel Kommanditgesellschaft auf Aktien, Dueselldorf (DE)

( * ) Notice: Subject to any disclaimer, the term of this patent is extended or adjusted under 35 U.S.C. 154(b) by 0 days.

(21) Appl. No.: 09/554,038

(22) PCT Filed: Oct. 30, 1998

(86) PCT No.: PCT/EP98/06889

§ 371 (c)(1),
(2), (4) Date: Jul. 26, 2000

(87) PCT Pub. No.: WO99/24638

PCT Pub. Date: May 20, 1999

(30) Foreign Application Priority Data

Nov. 8, 1997 (DE) ..... 197 49 508

(51) Int. Cl.[7] ..... C23C 22/00
(52) U.S. Cl. ..... 148/251; 148/262; 428/472.3
(58) Field of Search ..... 148/251, 262; 428/472.3

(56) References Cited

U.S. PATENT DOCUMENTS

| | | | | |
|---|---|---|---|---|
| 4,264,378 A | 4/1981 | Oppen et al. | ..... | 148/6.15 |
| 5,378,292 A | 1/1995 | Miller et al. | ..... | 148/259 |
| 5,427,632 A | 6/1995 | Dolan | ..... | 148/259 |
| 5,904,786 A | 5/1999 | Wendel et al. | ..... | 148/262 |
| 5,976,272 A | 11/1999 | Seidel et al. | ..... | 148/261 |

FOREIGN PATENT DOCUMENTS

| | | |
|---|---|---|
| WO | WO9609422 | 3/1996 |
| WO | WO9617977 | 6/1996 |

*Primary Examiner*—John Sheehan
*Assistant Examiner*—Andrew L. Oltmans
(74) *Attorney, Agent, or Firm*—Stephen D. Harper; Arthur G. Seifert

(57) ABSTRACT

A process for the corrosion protection of steel strips coated with zinc or zinc alloy, characterised in that the steel strips coated with zinc or zinc alloy are brought into contact with an aqueous treatment solution having a pH within the range of from 1.5 to 3.5, which contains 1 to 20 g/l manganese(II) ions and 1 to 150 g/l phosphate ions, and the solution is dried without intermediate rinsing. Optionally the solution may contain in addition: up to 10 g/l zinc ions, up to 10 g/l nickel ions, up to 20 g/l titanium ions, up to 50 g/l silicon ions in the form of silicon compounds, up to 30 g/l fluoride ions, up to 150 g/l of one or more polymers or copolymers of polymerisable carboxylic acids selected from acrylic acid, methacrylic acid and maleic acid, and esters thereof with alcohols having 1 to 6 carbon atoms. The present invention also relates to the correspondingly-treated metal strips.

23 Claims, No Drawings

CORROSION PROTECTION FOR GALVANIZED AND ALLOY GALVANIZED STEEL STRIPS

FIELD OF THE INVENTION

This invention relates to a new process for the corrosion protection of steel strips coated with zinc or zinc alloy. The present process provides, on the one hand, a temporary corrosion protection for transport and storage purposes. In this connection, the term "temporary corrosion protection" means that the metal surfaces are effectively protected from corrosion during transport and storage periods until they are coated with a permanent anticorrosive layer, such as a lacquer. On the other hand, the process according to the present invention serves as a preliminary treatment of the metal surfaces prior to a coating, which may be carried out on the metal surfaces immediately after the application of the present process.

BACKGROUND OF THE INVENTION

As a measure for providing temporary corrosion protection, steel strips coated with zinc or zinc alloy are either simply oiled or, where greater corrosive stresses are anticipated, they are phosphated or chromed. These measures are, however, inadequate in the case of particularly high corrosive stresses, such as ship transport in a salty sea atmosphere or storage in a tropical environment. The best-known temporary corrosion protection measure is chroming, during which the metal surfaces are coated with a chromium (III)- and/or chromium(VI)-containing layer generally in a layer weight generally of about 5 to about 15 mg/m$^2$ chromium. Owing to the well-known toxicological problems of chromium compounds, this process is disadvantageous and expensive from the aspects of industrial safety, the environment and the necessary disposal.

Moreover, chromed metal sheets are not very suitable for a subsequent phosphating, as, on the one hand, they result in a contamination of the cleaning solutions by chromium and, on the other hand, the whole of the metal surface cannot as a rule be phosphated. A phosphating as an alternative measure for providing temporary corrosion protection may alter the appearance of the metal surfaces in an undesirable way. A phosphating is, moreover, expensive as regards plant, as, depending on the substrate material, it requires an additional activating step and, after the phosphating, it generally requires a passivating step. The passivating is frequently carried out using treatment solutions containing chromium, as a result of which the above-mentioned disadvantages of the use of chromium-containing treatment solutions also arise here.

SUMMARY OF THE INVENTION

An object of the present invention is to provide a process for the corrosion protection of steel strips coated with zinc or zinc alloy, which is less problematic environmentally and is simpler to carry out technically than are the above-mentioned corrosion protection measures. This new process is to be at least equal to the conventional processes with regard to coatability and adhesion of the coating, but in addition, is to improve the corrosion protection for storage purposes.

This object is fulfilled by a process for the corrosion protection of steel strips coated with zinc or zinc alloy, characterised in that the steel strips coated with zinc or zinc alloy are brought into contact with an aqueous treatment solution having a pH of from 1.5 to 3.5, which contains:

| | |
|---|---|
| 1 to 20 | g/l manganese(II) ions and |
| 1 to 150 | g/l phosphate ions, |

and the solution is dried without intermediate rinsing.

DETAILED DESCRIPTION OF THE INVENTION

Electrolytically zinc-coated or hot-dip zinc-coated steel strips accordingly are suitable as substrate materials for the process according to the present invention. The steel strips may also be coated with zinc alloy, that is, they may have a layer of zinc alloy applied electrolytically or in the hot-dipping process. Here, the most important alloying components for zinc are iron, nickel and/or aluminum. The thickness of the zinc layer or of the layer of zinc alloy is generally between about 2 and about 20 micrometers, in particular between about 5 and about 10 micrometers.

The applied treatment solution is dried without intermediate rinsing. Processes of this type are known in the industry as no-rinse processes or dry-in-place processes. In the process, the treatment solutions may be sprayed onto the metal surfaces or applied by passing the steel strips through the treatment bath. The required quantity of the treatment solution remaining on the metal surface which results in the intended layer weight of 1 to 5 g/m$^2$ may be adjusted here by squeezing rollers. However, it is useful to apply the treatment solution directly in the required layer weight by a system of rollers, for example, of the type known as "Chem-coater".

The treatment solution for the process according to the present invention contains from 1 to 150 g/l, preferably 10 to 70 g/l, phosphate ions. Here, the phosphate content is calculated as phosphate ions. The person skilled in the art is, however, aware that, at the pH within the range of 1.5 to 3.5 to be established according to the present invention, only a very small proportion of the phosphate is present as triply negatively charged phosphate ions. Rather, there is an equilibrium of free phosphoric acid, primary and secondary phosphate ions, which is dependent on the acid constants of the phosphoric acid for the various protolysis steps and on the pH actually selected. Within the selected pH range, the greater part of the phosphate is present as free phosphoric acid and as primary and secondary phosphate ions.

The corrosion protection to be achieved by the process according to the present invention may be further improved if the treatment solution contains in addition one or more of the following components:

up to 10 g/l, preferably between 2 and 4 g/l, zinc ions, up to 10 g/l, preferably from 3 to 6 g/l, nickel ions, up to 20 g/l, preferably between 3 and 7 g/l, titanium ions, which are used preferably as hexafluorotitaniate ions, up to 50 g/l, preferably between 15 and 25 g/l, silicon ions in the form of silicon compounds, such as hexafluorosilicate ions and/or finely-disperse silica having an average particle size of less than 10 $\mu$m, up to 30 g/l fluoride ions, which may be introduced as free fluoride in the form of hydrofluoric acid or of soluble alkali metal fluorides or ammonium fluoride or in the form of hexafluoro anions of titanium or of silicon. Free fluoride, irrespective of whether it is introduced into the solution as free acid or as soluble salt, at the pH to be established in the treatment solution, will be present as a mixture of hydrofluoric acid and of free fluoride ions.

The treatment solution may also contain up to 150 g/l, preferably between 60 and 125 g/l, of one or more polymers or copolymers of polymerisable carboxylic acids selected from acrylic acid, methacrylic acid and maleic acid, and esters thereof with alcohols having 1 to 6 carbon atoms. When in this connection reference is made generally to the "treatment solution", this means that the organic polymers, depending on type, may also be present as a suspension in the solution of active substances. It is also the case here that, depending on acid constants of the carboxylic acids used, at the established pH of the treatment solution, these are present as a mixture of free acids and acidic anions. It is particularly preferred that one or more polymeric carboxylic acids be used, together with at least one of the above-mentioned optional components zinc, nickel, titanium, silicon and fluoride.

Manganese and, if desired, zinc and nickel may be introduced into the treatment solution in the form of water-soluble salts, for example, as nitrates. It is preferred, however, not to introduce any other foreign ions into the treatment solution apart from the components given above. Manganese, zinc and nickel are therefore introduced preferably in the form of the oxides or carbonates, so that they are ultimately present as phosphates in the treatment solution. It is also preferable that titanium, silicon and fluoride be used in the form of hexafluoric acid. If need be, the silicon may be introduced in the form of finely disperse silicas having a specific surface preferably within the range of from 150 to 250 $m^2/g$.

The temperature of the treatment solution on contact with the metal surface is preferably to be within the range of about 20 to about 4° C. Lower temperatures slow down the reaction rate and lead to an increasingly weaker corrosion protection; more elevated temperatures shorten the contact time through rapid drying and are therefore likewise disadvantageous. After a contact time, which depends on the speed of the conveyor, in the case of application by spraying or dipping on the length of the treatment zone and in every case on the distance between treatment zone and drying device, and which as a rule is between 1 and 6 seconds, the treatment solution is dried by elevating the temperature. This may be effected by irradiating the metal surfaces using infra-red radiation. However, it is easier to pass the metal strips, still wet from the treatment solution, through a drying oven. This should be at such a temperature that the resulting temperature of the object, that is, the temperature of the metal surface, is within the range of about 60 to about 120° C. In English usage, this temperature of the object is also referred to as "peak metal temperature".

In a further aspect, the present invention relates to a metal strip of steel coated with zinc or zinc alloy, having an anticorrosive layer containing manganese and phosphate, which may be obtained by bringing the metal strip into contact with an aqueous treatment solution having a pH within the range of from 1.5 to 3.5, which contains:

| | |
|---|---|
| 1 to 20 | g/l manganese(II) ions and |
| 1 to 150 | g/l phosphate ions, |

and drying the solution without intermediate rinsing.

Here, too, the treatment solution preferably contains one or more of the components listed above and is applied in the manner described above. Here, the metal strip may have one or more coating layers above the manganese- and phosphate-containing anticorrosive layer produced in the process according to tile present invention. These coating layers may have been applied, for example, by powder coating or by the so-called "coil-coating process". By "coil coating" it is meant that the coating layer or layers is/are applied by means of rollers to the moving metal strips and are then baked.

EXAMPLES

The present invention was tested on sample plates of hot-dip zinc-coated steel. Because these were covered with an anticorrosive oil, they were first cleaned using a commercially available alkaline cleaning agent. In the practical application of the process on factory production lines, the cleaning step may, however, be omitted if the present process immediately follows the process of zinc-coating or coating with zinc alloy. The treatment solutions shown in Table 1, which were at a temperature of 20° C. and had a pH of 3.2, were applied to the sample plates by dipping and adjusted to a wet film thickness of 6 $ml/m^2$ by centrifuging at 550 revolutions per minute. The wetted plates were then dried in a circulating-air drying cabinet regulated at 75° C. The temperature of the drying cabinet and the drying time resulted in an estimated "peak metal temperature" of 70° C.

The pretreated sample plates according to the present invention and comparison plates which were untreated or chromed as in the prior art were subjected to a constant alternating climate test in accordance with DIN 50017 and a salt spray test in accordance with DIN 50021 SS. In the course of this, the number of days before the sample plates attained a visually assessed degree of rusting 5 was recorded. The results are reproduced in Tables 2 and 3.

TABLE 1

| | Bath compositions (g/l in deionised water) | | | |
|---|---|---|---|---|
| Component | Example 1 | Example 2 | Example 3 | Example 4 |
| Mn | 3.2 | 5.4 | 9 | 9 |
| Phosphate | 6 | 10 | 91 | 91 |
| Zn | — | — | 3 | 3 |
| Ni | — | — | 3 | 3 |
| Ti (as $H_2TiF_6$) | 5 | 8 | — | — |
| Si (as $SiO_2$ dispersion) | — | — | — | 38 |
| Acrylic acid polymer | 125 | 75 | 75 | — |

TABLE 2

| Constant alternating climate test in accordance with DIN 50017: days to attain degree of rusting 5 | | | | | |
|---|---|---|---|---|---|
| | | Treatment with solution of | | | |
| untreated | chromed | Ex. 1 | Ex. 2 | Ex. 3 | Ex. 4 |
| 1 | 7 | >142 | >142 | >142 | >142 |

TABLE 3

| Salt spray test in accordance with DIN 50021 SS: days to attain degree of rusting 5 | | | | | |
|---|---|---|---|---|---|
| | | Treatment with solution of | | | |
| untreated | chromed | Ex. 1 | Ex. 2 | Ex. 3 | Ex. 4 |
| <0.5 | 6 | 7 | 7 | 10 | 8 |

What is claimed is:

1. A process for protecting a steel strip coated with zinc or a zinc alloy comprising (a) contacting the steel strip with an aqueous treatment solution having a pH of from 1.5 to 3.5 and comprising
(i) 1 to 20 g/L manganese (II) ions;
(ii) 1 to 150 g/L phosphate ions; and
(iii) one or more organic polymers selected from the group consisting of polymers and copolymers of polymerizable carboxylic acids, at least one of said polymerizable carboxylic acids being selected from the group consisting of acrylic acid, methacrylic acid, maleic acid and esters thereof with alcohols having 1 to 6 C atoms; and (b) drying the aqueous treatment solution without intermediate rinsing.

2. The process of claim 1 wherein the aqueous treatment solution is comprised of at most 150 g/L of said organic polymers.

3. The process of claim 1 wherein the aqueous treatment solution is comprised of between 60 and 125 g/L of said organic polymers.

4. The process of claim 1 wherein the aqueous treatment solution is additionally comprised of zinc ions.

5. The process of claim 1 wherein the aqueous treatment solution is additionally comprised of zinc ions in a concentration up to 10 g/L.

6. The process of claim 1 wherein the aqueous treatment solution is additionally comprised of nickel ions.

7. The process of claim 1 wherein the aqueous treatment solution is additionally comprised of nickel ions in a concentration up to 10 g/L.

8. The process of claim 1 wherein the aqueous treatment solution is additionally comprised of titanium ions.

9. The process of claim 1 wherein the aqueous treatment solution is additionally comprised of titanium ions in a concentration up to 20 g/L.

10. The process of claim 1 wherein the aqueous treatment solution is additionally comprised of silicon in the form of silicon compounds.

11. The process of claim 1 wherein the aqueous treatment solution is additionally comprised of silicon in the form of silicon compounds in a concentration up to 50 g/L.

12. The process of claim 1 wherein the aqueous treatment solution is additionally comprised of fluoride ions.

13. The process of claim 1 wherein the aqueous treatment solution is additionally comprised of fluoride ions in a concentration up to 30 g/L.

14. The process of claim 1 wherein the aqueous treatment solution is at a temperature of from 20° C. to 40° C. during contacting step (a).

15. The process of claim 1 wherein said contacting is performed for a time of from 1 to 6 seconds.

16. The process of claim 1 wherein drying step (b) is performed by heating the steel strip to a temperature of from 60° C. to 120° C.

17. The process of claim 1 wherein the aqueous treatment solution is present on the steel strip at a layer weight of 1 to 5 g/m$^2$ prior to step (b).

18. The process of claim 1 wherein the aqueous treatment solution comprises 10 to 70 g/L phosphate ions.

19. The process of claim 1 wherein at least one of the organic polymers is an acrylic acid polymer.

20. A steel strip coated with zinc or a zinc alloy having an anticorrosive layer comprised of manganese and phosphate, said steel strip being produced by the process of claim 1.

21. The steel strip of claim 20 additionally having one or more coating layers above the anticorrosive layer.

22. A process for protecting a steel strip coated with zinc or a zinc alloy comprising (a) contacting the steel strip for a time of from 1 to 6 seconds with an aqueous treatment solution having a pH of from 1.5 to 3.5 and a temperature of 20° C. to 40° C., and comprising
(i) 1 to 20 g/L manganese (II) ions;
(ii) 10 to 70 g/L phosphate ions;
(iii) 60 to 125 g/L of one or more organic polymers selected from the group consisting of polymers and copolymers of polymerizable carboxylic acids, at least one of said polymerizable carboxylic acids being selected from the group consisting of acrylic acid, methacrylic acid, maleic acid and esters thereof with alcohols having 1 to 6 C atoms; and
(iv) one or more of the following components
(aa) 2 to 4 g/L zinc ions;
(bb) 3 to 6 g/L nickel ions;
(cc) 3 to 7 g/L titanium ions;
(dd) 15 to 25 g/L silicon in the form of silicon compounds;
(ee) fluoride ions, in a concentration of up to 30 g/L; and (b) without intermediate rinsing, drying the aqueous treatment solution which is present on the steel strip at a layer weight of 1 to 5 g/m$^2$ by heating the steel strip to a temperature of 60° C. to 120° C.

23. A steel strip coated with zinc or a zinc alloy and having an anticorrosive layer comprised, of manganese and phosphate, said steel strip being produced by the process of claim 22.

* * * * *

UNITED STATES PATENT AND TRADEMARK OFFICE

CERTIFICATE OF CORRECTION

PATENT NO. : 6,537,387 B1
DATED : March 25, 2003
INVENTOR(S) : Joerg Riesop

It is certified that error appears in the above-identified patent and that said Letters Patent is hereby corrected as shown below:

Title page,
Item [73], Assignee, delete "Dueselldorf" and insert therefor -- Duesseldorf --.

Column 6,
Line 52, after "comprised", delete ",".

Signed and Sealed this

Fifth Day of August, 2003

JAMES E. ROGAN
*Director of the United States Patent and Trademark Office*